US005746881A

United States Patent [19]

Jenkins et al.

[11] Patent Number: 5,746,881

[45] Date of Patent: May 5, 1998

[54] MOISTENER FOR A POSTAGE METER

[75] Inventors: Ian R. Jenkins, Fairfield; Walter J. Kulpa, Trumbull; Howard M. Stevens, Stratford; Chiping Sye, Stamford, all of Conn.; Christopher V. Hibberd, Essex, England

[73] Assignee: Pitney Bowes Inc., Stamford, Conn.

[21] Appl. No.: 548,717

[22] Filed: Oct. 26, 1995

[51] Int. Cl.[6] ..... B43M 5/00

[52] U.S. Cl. ..... 156/578; 156/441.5; 118/268

[58] Field of Search ..... 156/441.5, 442.1, 156/578, 547, 442.2; 118/32, 264, 268

[56] References Cited

U.S. PATENT DOCUMENTS

| | | | |
|---|---|---|---|
| 3,811,407 | 5/1974 | Lupkas et al. | 118/264 X |
| 4,948,453 | 8/1990 | Nobile et al. | 118/268 X |
| 4,995,934 | 2/1991 | Janatka | 156/442.1 X |
| 5,022,953 | 6/1991 | Fassman et al. | 156/441.5 |
| 5,073,227 | 12/1991 | Rehberg | 156/441.5 |
| 5,209,806 | 5/1993 | Hibberd | 156/441.5 |
| 5,385,627 | 1/1995 | Weimer | 156/442.2 X |

*Primary Examiner*—James Engel
*Attorney, Agent, or Firm*—Angelo N. Chaclas; Charles G. Parks, Jr.; Melvin J. Scolnick

[57] ABSTRACT

The moistening system is used in combination with a postage meter system, wherein the postage meter system includes a horizontal extend deck supported by a meter housing. A portion of the deck defines a printing station. The moistening system includes a housing defining a first chamber. A horizontally extending feed deck is detachably mounted to the housing enclosing the first chamber. A second chamber defined by the housing includes a latching mechanism for detachably mounting the housing and feed deck to the postage meter such that the feed deck is aligned contiguous to the deck of the postage meter. A reservoir container is removably mounted within the first chamber of the housing and has an aperture aligned to an aperture formed in the feed deck. A wick assembly includes a support brace is detachably mounted to the feed deck, a wick and a cap. The support brace has a first section extending into the reservoir and the wick has a first section confined by the first section of the support brace to extend into the reservoir. The support brace also has a second section extending horizontally in spaced apart relation to the feed deck and supporting a second section of the wick such that a portion of the wick extends horizontally beyond the second section of the brace. A cap is detachably mounted to the second section of the brace to securely position the second section of the wick therebetween.

5 Claims, 2 Drawing Sheets

MOISTENER FOR A POSTAGE METER

BACKGROUND OF THE INVENTION

This invention relates to a postage meter having a moistener for moistening envelope flaps prior to the printing of a postage indicia.

It is a general objective to develop postage metering systems which are less expensive in order to promote the use of such meters in home and small offices. One such, postage metering system employs a base having a deck for the placement of an envelope just below a printing station. Once the envelope is properly positioned below the meter printing station, a postage indicia is printed on the envelope using any suitable printing technique, such as thermal printing.

It is considered advantageous to provide a convenient means of moistening the glue line of a envelope flap just prior to printing as part of the postage meter system. Generally, the printing process compresses the envelope flap against the body of the envelope to ensure sealing.

SUMMARY OF THE INVENTION

It is an object of the present invention to present a feed deck arrangement which can be detachably mounted to a suitable postage meter and which includes an envelope moistening arrangement that is inexpensive and effective in moistening the glue line of an envelope flap. The feed deck, including a moistener, is configured as a stand alone module to permit the postage meter to be used with or without the attachment of the feed deck module.

The feed deck is comprised of a base section defining a formed well. Within the well is a reservoir container with an aperture located at the top portion of the reservoir container. A horizontally extending deck is positioned over the base section to enclose the reservoir container and includes an aperture aligned to the aperture in the reservoir. The deck also has a depression form therealong. A wick assembly which includes a vertical extending portion is positioned such that a portion of a wick is received in the reservoir through the apertures. Another portion of the wick assembly extends horizontally and slightly above the depression formed in the deck. The wick assembly includes a stiffener which maintains the position and alignment of that portion of the wick which extends over the formed depression in the deck. The horizontal portion of the wick is appropriately spaced above the deck depression to allow an operator to position an envelope flap between the deck depression and the wick such that the flap glue comes into contact with the wick which receives moistening fluid from the reservoir. The operator can then traverse the envelope flap across the wick.

DETAILED DESCRIPTION OF THE PREFERRED EMBODIMENT

Figure 1:
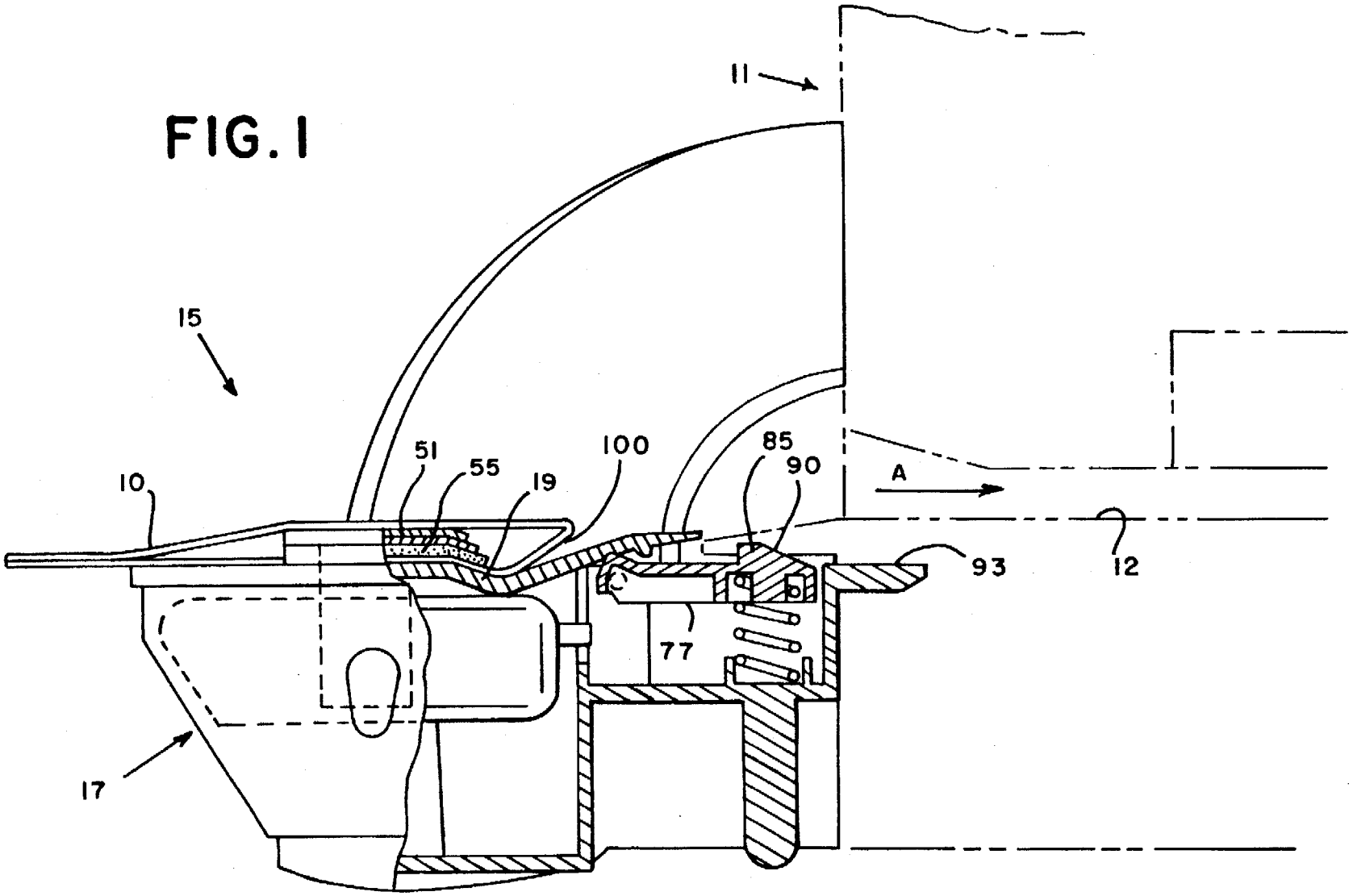
FIG. 1 is a sectioned frontal view of a deck and moistener combination in accordance with the present invention.

Referring to FIG. 1, a thermal postage meter 11 is partly shown in FIG. 1 in phantom. The postage meter 11 includes a print deck 12. A feeder assembly 15 is detachably mounted to the meter 11 which in turn receives an envelope 10 from the feeder assembly 15 in the direction indicated by arrow "A".

Figure 2:
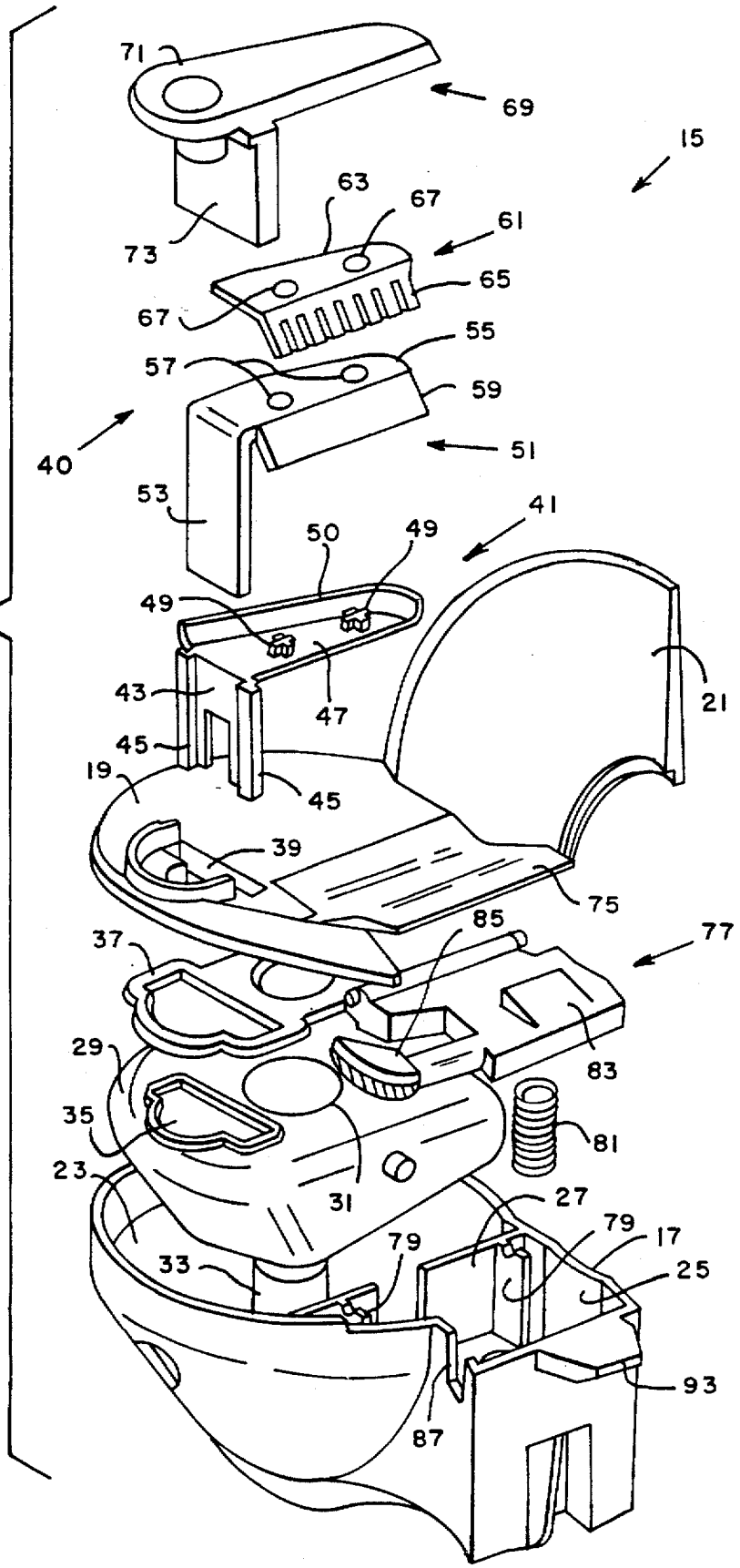
FIG. 2 is an exploded view of the deck and moistener combination in accordance with the present invention.

Referring to FIGS. 1 and 2, the feeder assembly 15 is comprised of a housing 17 supporting a feed deck 19 horizontally aligned to the print deck 12. Vertically extending from the print deck 12 along the rearward facing of the feed deck 19 is a registration wall 21. The housing 17 defines internal chambers 23 and 25. A separation wall 27 is formed in the housing 17 separating the chamber 23 and chamber 25.

A fluid reservoir container 29 is received within the first chamber 23 below the feed deck 19. The container 29 has a formed alignment slot 31 positioned for receiving an alignment pin 33 formed on an interior side surface of the chamber 23. The fluid reservoir container 29 includes a top located reservoir entrance or aperture 35. Positioned around the reservoir entrance 35 is a moistener seal 37 of any suitable material, such as, a moderate durameter rubber. A slotted aperture 39 formed in the feed deck 19 is aligned to the reservoir entrance 35 positioning the seal 37 between the reservoir 29 and the underside of the feed deck 19.

A wick assembly 40 is provided for moistening fluid transfer in a manner later described. The wick assembly 40 includes an L-shaped brace 41. The brace 41 is comprised of a vertical brace portion 43 having formed posts 45. The posts 45 are horizontally spaced apart and have a respective cross section sized to securely fit within the slotted aperture 39 of the deck 19. Formed to extend in a cantilevered manner from the brace portion 43 is a horizontal portion 47. The horizontal portion 47 has formed therealong a plurality of hubs 49. Also formed along one side of the horizontal portion 47 is a rim 50.

An L-shaped wick 51 is supportively positioned on the brace 41. The wick 51 includes a vertical strip portion 53 which extends downwardly between the formed posts 45 of the brace 41 into the reservoir 29 through the aperture 35. The wick 51 also includes a horizontal portion 55 which is positioned on the horizontal portion 47. The horizontal portion 55 of the wick 51 has formed therein apertures 57 through which the hubs 49 of the portion horizontal portion 47 extend. The wick 51 also includes a wick flap 59 which extends forwardly from the horizontal portion 55 of the wick 51 and beyond one edge of the horizontal portion 47 of the brace 41 A stiffener 61 is then positioned atop the wick portion 59. The stiffener 61 is comprised of a base portion 63 and a forwardly extending slotted fanged portion 65. The base portion 63 includes apertures 67 formed in the base of the stiffener 61 aligned to apertures 57 in the wick to receive the hubs 49 of brace 41.

A generally T-shaped cap 69 includes a horizontal portion 71 which is partly configured to be received within the rim 50 area of the brace 41. The cap 69 also includes a vertically extending portion 73 which is sized to be received in the slot 39 of the feed deck 19 locating the wick portion 53 between the vertical brace portion 43 and laterally located between the vertically formed posts 45 of the brace 41.

The deck 19 also has a formed downwardly V-shaped recess 75 which is vertically aligned to the wick assembly 40. A deck locking plate 77 is pivotally mounted to a pair of mounting posts 79 formed in the chamber 25 generally below the recess 75. A spring 81 is secured at one end in the chamber 25 and at its other end to the underside of the locking plate 77 by any suitable conventional means. The locking plate 77 includes a formed locking notch 83. A hand tab 85 is formed on the locking plate 77 and extends through a formed slot 87 in the housing 17. The housing 17 further includes an alignment tab 93 for assisting in mounting the feeder assembly 15 to the meter 11. Referring to FIG. 1, in a conventional manner, the housing 17 is secured to the meter 11 by causing tab 85 of the locking plate 77 to interlock with a notch 90 formed in the underside of the meter print deck 12. Depression of the hand tab 85 (not shown) causes the locking plate 77 to dislodge from the notch 90, allowing the housing 17 and attached members to be detached. It is optional to provide the housing 17 with an alignment tab 93 which is received in the alignment slot formed in the meter 11 (now shown), in any suitable conventional manner, to assure proper alignment.

It should now be appreciated that an envelope flap 100 can be manually positioned between the horizontal portion 55 of the wick 51 and deck 19 such that the glue line of the envelope 10 contacts the now moistened wick. Following which, the envelope can be manually manipulated to longitudinally traverse the wick 51 resulting in moistening of the envelope 10 adhesive glue. The envelope is thereafter positioned within the area of the meter print station (not shown). It should be further appreciated that the described moistening system has the advantage of low cost, improved reliability in that the wick stiffener maintains the preferred moistening profile of the wick and assures appropriate moistening contact between the wick and the envelope glue area.

What is claimed is:

1. A moistening system for a postage meter system, wherein said postage meter system includes a horizontally extending deck supported by a meter housing, a portion of said deck defining a printing station, said moistening system comprising:

a housing defining a first chamber;

a horizontally extending feed deck detachably mounted to said housing and enclosing said first chamber, said feed deck having an aperture;

attachment means for detachably mounting said housing and said feed deck to said postage meter such that said feed deck is aligned contiguous to said deck of said postage meter;

a reservoir container removably mounted within said first chamber of said housing and having an aperture aligned to the aperture formed in said feed deck; and a wick assembly having a support brace detachably mounted to said feed deck, a wick and a cap wherein said support brace has a first section extending into said reservoir container and said wick having a first section confined by said first section of said support brace to extend into said reservoir container, said support brace having a second section extending horizontally in spaced apart relation to said feed deck and supporting a second section of said wick such that a portion of said wick extends horizontally beyond said second section of said brace, said cap being detachably mounted to said second section of said brace to securely position said second section of said wick therebetween.

2. A moistening system for a postage meter system as claimed in claim 1, wherein said wick assembly further includes a stiffener member having a first stiffener section securely positioned by said cap between said cap and said second section of said wick and said stiffener having a second section adjacent to said portion of said second wick section and angled to angle said second wick section extending beyond said second brace section towards said feed deck.

3. A moistening system for a postage meter system as claimed in claim 2, wherein said housing further includes a second chamber enclosed by said feed deck, said attachment means having a lever pivotally mounted in said second chamber to assume a first or second position and a spring biasing said leer in said first position; said lever having a first portion extending through an opening between said housing and said feed deck to latchably engage said postage meter housing in said first position and detach from said postage meter housing in said second position, said lever having a second portion extending through a second aperture in said housing such that said lever second portion can be manually manipulated to cause said lever to assume said second position.

4. A moistening system for a postage meter system, wherein said postage meter system includes a horizontal extend deck supported by a meter housing, a portion of said deck defining a printing station, said moistening system comprising:

a housing defining a first chamber;

a horizontally extending feed deck detachably mounted to said housing, enclosing said first chamber;

attachment means for detachably mounting said housing and feed deck to said postage meter such that said feed deck is aligned contiguous to said deck of said postage meter;

reservoir container removably mounted within said first chamber of said housing and having a aperture aligned to an aperture formed in said feed deck; and, a wick assembly having a support brace detachably mounted to said feed deck, a wick and a cap wherein said support brace has a first section extending into said reservoir container and said wick having a first section confined by said first section of said support brace to extend into said reservoir container, said support brace having a second section extending horizontally in spaced apart relation to said feed deck and supporting a second section of said wick such that a portion of said wick extends horizontally beyond said second section of said brace, said cap being detachably mounted to said second section of said brace to securely position said second section of said wick therebetween;

said housing further includes a second chamber enclosed by said feed deck, said attachment means having a lever pivotally mounted in said second chamber to assume a first or second position and a spring biasing said lever in said first position; said lever having a first portion extending through a second aperture of said housing to latchably engage said postage meter housing in said first position and detach from said postage meter housing in said second position, said lever having a second portion extending through a third aperture in said housing such that said lever second portion can be manually manipulated to cause said lever to assume said second position.

5. A moistening system for a postage meter system as claimed in claim 4, wherein said wick assembly further includes a stiffener member having a first stiffener section securely positioned by said cap between said cap and said second section of said wick and said stiffener having a second section adjacent to said portion of said second wick section and angled to angle said second wick section extending beyond said second brace section towards said feed deck.

* * * * *